US008388776B2

(12) United States Patent
Buscher et al.

(10) Patent No.: US 8,388,776 B2
(45) Date of Patent: Mar. 5, 2013

(54) METHOD FOR THE β ANNEALING OF A WORK PIECE PRODUCED FROM A TI ALLOY

(75) Inventors: Markus Buscher, Drolshagen (DE); Thomas Witulski, Meinerzhagen (DE)

(73) Assignee: Otto Fuchs KG, Meinzerhagen (DE)

( * ) Notice: Subject to any disclaimer, the term of this patent is extended or adjusted under 35 U.S.C. 154(b) by 0 days.

(21) Appl. No.: 13/147,797

(22) PCT Filed: Jan. 29, 2010

(86) PCT No.: PCT/EP2010/051078

§ 371 (c)(1), (2), (4) Date: Sep. 19, 2011

(87) PCT Pub. No.: WO2010/089256

PCT Pub. Date: Aug. 12, 2010

(65) Prior Publication Data

US 2012/0000581 A1 Jan. 5, 2012

(30) Foreign Application Priority Data

Feb. 5, 2009 (DE) ..... 10 2009 003 430

(51) Int. Cl.
*C22F 1/18* (2006.01)

(52) U.S. Cl. ..... 148/669

(58) Field of Classification Search ..... 148/669, 148/671, 421

See application file for complete search history.

(56) References Cited

U.S. PATENT DOCUMENTS 5,201,457 A * 4/1993 Kitayama et al. ..... 228/144
5,277,718 A * 1/1994 Paxson et al. ..... 148/671
5,705,794 A 1/1998 Gillespie et al.
5,861,070 A * 1/1999 Reichman et al. ..... 148/671
6,726,784 B2 * 4/2004 Oyama et al. ..... 148/421

FOREIGN PATENT DOCUMENTS

GB 1141409 1/1969

OTHER PUBLICATIONS

Ivasishin O M et al: "Grain growth and texture evolution in Ti-6AI-4V during beta annealing under continuous heating conditions"; Materials Science & Engineering a (Structural Materials: Properties, Microstructure and Processing), vol. A337, No. 1-2, Nov. 25, 2002, pp. 88-96, XP002581190 Elsevier Switzerland ISSN: 0921-5093.

Lampman S.R., Zorc T.B.: "ASM Handbook—Heat Treating", 1991, ASM International, U.S., XP002581351,vol. 4, pp. 914-915.

International Search Report for related International Application No. PCT/EP2010/051078 dated Jun. 9, 2010 (4 pages).

International Preliminary Report on Patentability for related International Application No. PCT/EP2010/051078 dated Jun. 6, 2011 (6 pages).

* cited by examiner

*Primary Examiner* — Jessee R. Roe

(74) *Attorney, Agent, or Firm* — Margaret Polson; Oppedahl Patent Law Firm LLC

(57) ABSTRACT

A description is given of a method for the heat treatment of a workpiece produced from a titanium alloy for obtaining a fine-grained microstructure by annealing the same above its β-transus temperature $T_\beta$. According to the invention, the workpiece is heated in a furnace to a temperature level $T_H$ above its β-transus temperature $T_\beta$. Reaching the temperature level $T_H$ determines the beginning of a predefined holding time, for which the workpiece is kept at this temperature level $T_H$. The workpiece subsequently undergoes a cooling process. To carry out the heat treatment, the furnace temperature $T_F$ is set such that, for heating up the workpiece to the temperature level intended for carrying out the holding, it lies above the temperature level $T_H$ of the workpiece determining the beginning of the holding time.

2 Claims, 2 Drawing Sheets

METHOD FOR THE β ANNEALING OF A WORK PIECE PRODUCED FROM A TI ALLOY

CROSS REFERENCE APPLICATIONS

This application is a National Stage entry of PCT/EP2010/051078 filed Jan. 29, 2010, which claims priority from German application 10 2009 003 430.7 filed Feb. 5, 2009.

BACKGROUND

The invention relates to a method for the heat treatment of a work piece produced from a Ti alloy for obtaining a fine-grained structure by annealing the work piece above its β transus temperature (β annealing), whereby the work piece is heated in a furnace to a temperature level above its β transus temperature and the achieving of the temperature level determines the beginning of a holding time predefined as to its duration, and the work piece is held for the duration of the holding time at the temperature level before it is subjected to a cooling-off process.

Work pieces that consist of a titanium alloy are subjected to various heat treatments as a function of their chemistry and their intended use in order to impart to or adjust certain properties of the work piece. To this end, work pieces of titanium alloys are occasionally subjected to an annealing method. Depending on the alloy type and the particular desired property to be achieved, the main intended use of such annealing methods resides in an increase of the strength, the adjusting of a sufficient ductility as well as in a thermal stability and/or to increase the resistance to creeping. One of these heat treatment methods is the so-called β annealing. In this method the work piece is annealed to just above its β conversion temperature (β transus temperature) and subsequently subjected to a defined cooling-off process. The cooling-off process can be cooling in air, in an inert gas to room temperature or can also be a quenching. The hexagonal α phase contained in the Ti alloy is converted into a spatially centered β phase above the β transus temperature. The quenching process following the β annealing is typically designed to suppress the formation of α phase as much as possible during the cooling off or to separate it in a defined manner.

In the case of work pieces of Ti alloys, they can be structural components, for example, for being used in airplane construction. Such structural components typically have a not-inconsiderable thickness. During the β annealing of such a work piece particular care is required in order to achieve the desired properties. To this end standards have been developed according to which such Ti structural components must be β-annealed. The standardizing of the β annealing process is intended to ensure that during an industrial usage the work pieces have the most uniform grain structure possible. A problem in β annealing is that keeping the work piece above its β transus temperature for too long result in an undesired grain coarsening. According to the standards in force, such as AMS-H-81200B or DIN 65084, it is required that the work piece be heated to a temperature 30° C. above the β transus temperature of the Ti alloy. The temperature level to which the work piece is to be heated, which lies above the β transus temperature, has a sufficient temperature difference from the β transus temperature, which level is also ensured taking into consideration the system-conditioned temperature tolerances (β transus temperature, furnace temperature), so that the work piece is heated as a whole upon achieving the temperature level above the β transus temperature. For the adjusted furnace temperature, generally a tolerance range of ±14° C. is given. A β annealing is carried out in accordance with these settings by heating the work piece in a furnace. When the work piece temperature exceeds the lower tolerance limit of the predefined temperature level ($T_\beta$+30° C.−14° C.) determines the start point of the holding time. The holding time itself is preset, for example, at 30 minutes. Consequently, the work piece is kept in the furnace for the duration of the holding time at a temperature level above $T_\beta$+30° C.−14° C. and is subsequently subjected to a cooling-off process. Such a method is known in principle from GB 1,141,409. This document describes a method for the refining of the grain of the microstructure of an α or β titanium alloy. The work piece is heated to a temperature above the β transus temperature in order to obtain a substantially complete conversion into the β phase. The work piece is held at this temperature until it has been sufficiently ensured that a complete conversion into the β phase has taken place. A holding time of one hour is indicated as an example. The work piece is subsequently quenched to a temperature sufficiently far below the β transus temperature to bring a significant part of the β phase into an α phase or an α-equivalent phase. In a following step the shaped part is plastically deformed. The annealing referred to in this document is an intermediate step in the production of the material in the "annealed state" with a grain structure of globular α phase that is adjusted after the β annealing and after a further D formation. No β annealing is described in this document that represents a final heat treatment with which the grain size of the β structure is refined, as was initially mentioned.

It turned out that in spite of the normative settings for the β annealing of work pieces consisting of a titanium alloy, they were not able to be produced with the necessary process safety and that they therefore can differ from each other as regards their structure and consequently their properties in spite of the same method parameters. However, this is not desired.

Starting from this discussed state of the art, the invention therefore has the problem of designing an initially cited method in such a manner that a β annealing of work pieces consisting of a titanium alloy is possible with a higher degree of process safety.

SUMMARY

The invention solves this problem by an initially cited generic method in which the heat treatment is carried out in a furnace whose adjusted furnace temperature for heating the work piece to the temperature level provided for carrying out the holding lies above the temperature level of the work piece that determines the beginning of the holding time.

In distinction to the prevailing opinion for adjusting the furnace temperature only slightly above the β transus temperature in order to avoid a grain coarsening, in the suggested method the furnace is adjusted to a temperature that is above the temperature level at the exceeding of which the holding time begins to run. The property is utilized in this method that the temperature has only a subordinate influence on the grain growth within the considered temperature window above the β transus temperature. Instead, the holding time is decisive for the grain growth and the grain size of the β annealed work piece. The adjusting of the furnace temperature to a temperature with a distinct difference from the temperature when the time span of the holding begins results in the time span between when the work piece exceeds its β transus temperature and when it achieves the temperature level that determines the beginning of the holding time is significantly shorter in comparison to a traditional β annealing. This is a consequence of the faster heating of the workpiece by the higher furnace temperature adjusted in accordance with the invention. This method also makes use of the heating behavior of a Ti work piece whose heating gradient decreases with increasing temperature. The section of the heating curve of the work piece between its β transus temperature and the temperature level of the holding time has a higher gradient in comparison to the traditional β annealing process. The shortening of this time span, that does not belong to the holding time, and in which a conversion into the β phase takes place already distinctly reduces the extent of this conversion and the associated grain growth. This makes itself particularly noticeable in rather thick work pieces that have a correspondingly low heating-up rate, in particular in the last section of their heating-up curve. This results in the time span between exceeding of the β transus temperature and the beginning of the holding time being correspondingly long. In the previously known methods this resulted in the set holding time being considerably shorter than the time the work piece had to be heated raised from its β transus temperature to the temperature level for the holding.

The furnace setting temperature is adjusted as a function of the Ti alloy and of the geometry of the work piece. It is sufficient if the furnace setting temperature is 50° C. above the β transus temperature and therefore distinctly above the temperature level used for the holding of $T_\beta$+30° C.−14° C. The furnace setting temperature is not to be set too high for economic reasons. The maximal furnace setting temperature is to be selected as a function of the temperature-conditioned grain size growth and of the provided holding time and of the expected time span that is required for the heating of the work piece from its β transus temperature to the temperature level of the holding time. Tests have shown that even a furnace setting temperature of $T_\beta$+100° C. results in the expected results without too great a grain growth. This is conditioned by the increasing heating during the holding time having to be accepted. At a furnace setting temperature of $T_\beta$+100° C. the time span for the heating of the work piece from its β transus temperature to the temperature level of the holding time is correspondingly short. During an execution of the method with a furnace setting temperature for heating the work piece which is considerably above the β transus temperature, it is possible, after having achieved the temperature provided for the holding, to lower the furnace temperature to a temperature that is only slightly above the β transus temperature. This, for its part, reduces a temperature-conditioned grain growth.

It is suggested for the first time by the claimed method to use the furnace temperature as a regulated quantity to considerably improve the process of a β annealing of a work piece produced from a Ti alloy, in particular to be able to produce the work piece produced with this heat treatment method with a process that is safe as regards the desired property. It can absolutely be provided here that the furnace temperature is used as an active regulated quality that is lowered from a first set temperature after the work piece has reached a predetermined temperature.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
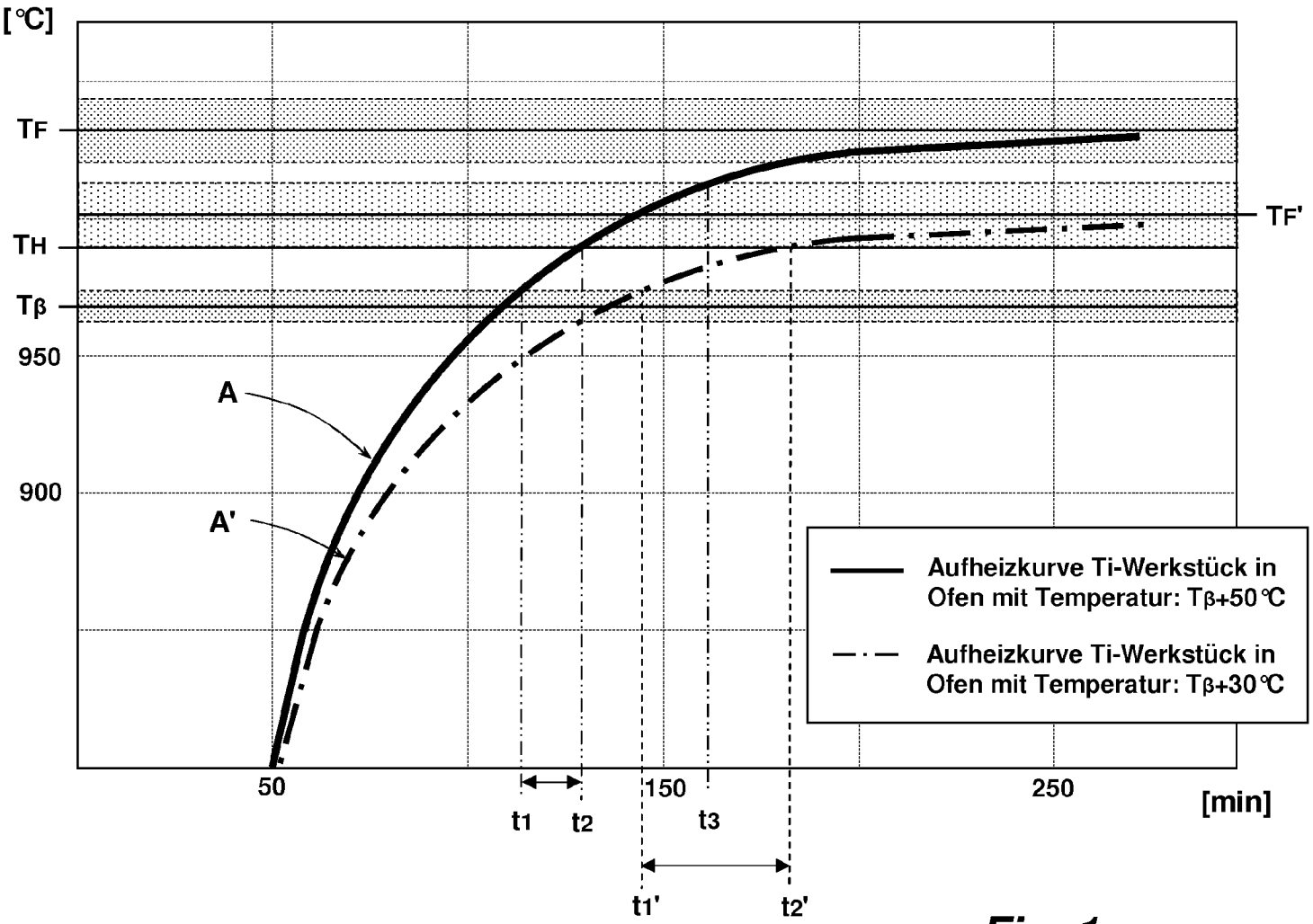
FIG. 1 is a schematically represented heating-up curve for a work piece consisting of a Ti alloy for carrying out a β annealing in accordance with the method of the invention in a comparison with the heating-up curve of a work piece consisting of the same alloy in accordance with the traditional β annealing method.

In the graph of FIG. 1 the β annealing of the work piece consisting of a Ti alloy is represented using a temperature/time diagram. The heating-up curve A of a Ti work piece produced in the represented exemplary embodiment from a Ti6A14V alloy is entered into the diagram. The chemistry of a Ti6A14V alloy is reproduced in the following:

| Al | V | Fe | O | C | N | H | Y | Others, individually | Others, sum | Ti |
|---|---|---|---|---|---|---|---|---|---|---|
| 5.5-6.75 | 3.5-4.5 | max. 0.30 | max. 0.20 | max. 0.08 | max. 0.05 | max. 0.0125 | max. 0.005 | 0.10 | 0.40 | remainder |

The Ti work piece whose heating-up curve A is represented in FIG. 1 for the process of the β annealing has the following composition:

| Al | V | Fe | O | C | N | H | Y | Others, individually | Others, sum | Ti |
|---|---|---|---|---|---|---|---|---|---|---|
| 5.98 | 3.86 | 0.18 | 0.11 | 0.006 | 0.005 | 0.0017 | <0.005 | <0.10 | <0.30 | remainder |

The β transus transfer temperature $T_\beta$ of the Ti alloy used for this work piece is approximately 970° C. The furnace in which the work piece is to be subjected to the β annealing process is adjusted to a temperature of $T_{62}$ +50° C. in the exemplary embodiment shown. Thus, the furnace setting temperature is $T_F$1,020° C. The β transus temperature $T_\beta$ as well as the set furnace temperature $T_F$ are shown on the diagram as a solid line, whereby the tolerance range of the two temperatures $T_\beta$ and $T_F$ are shown with shading above and below the particular temperature $T_\beta$ and $T_F$. The lower limit of the temperature level $T_H$ determined for the holding of the work piece for the β annealing process is also shown. The time of when the work piece reaches temperature $T_H$ then determines the beginning of the holding time—the time span that the work piece is left at or above the temperature $T_H$ to carry out the β annealing in accordance with the specifications. In the exemplary embodiment shown the lower limit of the temperature level for the holding time is the temperature that also defines the beginning of the holding time in traditional methods, namely, $T_\beta$+30° C.−14° C. for the Ti6A14V alloy in question.

The heating of the Ti work piece can take place starting from a cold furnace or in an already preheated furnace. The heating-up curve A is determined by a heating gradient that increasingly decreases after a certain temperature. The smaller the temperature difference between the actual temperature of the work piece and between the furnace setting temperature $T_F$, the smaller the heating gradient. During the continuing heating the temperature of the work piece exceeds at time $t_1$ the upper limit of the tolerance of the β transus temperature $T_\beta$. In order to ensure that the work piece has been heated as a whole to a temperature above the upper limit of the tolerance range of the β transus temperature $T_\beta$, the lower limit of the temperature level $T_H$ is above the upper limit of the tolerance range of the β transus temperature $T_\beta$. When the work piece has reached the temperature $T_H$ provided for the holding at time $t_2$, the holding time begins. The holding time is predefined regarding its duration, and which is selected to be 30 minutes in the present exemplary embodiment. After expiration of the holding time, that is shown in the diagram of FIG. 1 at time $t_3$, the work piece is removed from the furnace and subjected to a defined cooling-off process. In the exemplary embodiment presented the heating-up curve A, the time interval between the times $t_1$, $t_2$ has a duration of approximately 15-20 min.

Once the work piece has been heated to its holding temperature the furnace can be changed to a lower temperature level. This reduces the energy consumption and the influence, even if small, of the temperature on the grain growth above the β transus temperature. This takes place at time $t_2$ or shortly thereafter. The furnace temperature can be lowered to the temperature provided for the holding, which is $T_\beta$+30° C.−14° C. in the exemplary embodiment presented.

The previously described β annealing is compared in FIG. 1 with the traditional (β annealing of a Ti work piece. This Ti workpiece has the same alloy composition as the one that was heat-treated with the β annealing in accordance with the invention. In the previously known β annealing the furnace setting temperature was $T_F'$=$T_\beta$+30° (1,000° C.). The tolerance range above and below is also shown for this temperature $T_F'$ by shading. Based on the lower furnace setting temperature $T_F'$ compared with the exemplary embodiment of the invention, the heating process of the work piece shown in FIG. 1 is on the whole slower, following its heating-up curve A' shown in dotted lines. At time $t_1'$ the upper limit of the tolerance range of the β transus temperature is exceeded and at time $t_2'$ the lower limit of temperature level $T_H$ of the holding time. If the temperature level $T_H$ is exceeded at time $t_2'$ the 30-minute holding time begins.

The comparison of the two heating-up curves A, A' makes it clear that the beginning of the holding time begins later relative to the entire process in the traditional β annealing (heating-up curve A') and therefore the duration of the process is longer than in the method of the invention described for heating-up curve A. In the traditional method the time interval between times $t_1'$ and $t_2'$ is about 40 minutes and is therefore approximately twice as long as in the method described for the claimed invention by way of the above exemplary embodiment. The shorter time span in the method of the invention between the time of the reaching of the β transus temperature or the lower limit of the tolerance range of this transus temperature and between the reaching of the temperature $T_H$ explains not only the higher process safety of this method but also the fact that the workpiece β-annealed with the method is on the whole more fine-grained and has a more homogenous distribution of grain size.

The previously described Ti workpieces, whose heating-up curves A, A' are contrasted in FIG. 1, are cylindrical sample bodies with a diameter of 200 mm and a height of 125 mm. Following the particular β annealing, an investigation of the grain size was carried out on both workpieces. The result showed that in the β annealing carried out in accordance with the state of the art an average grain size of 0.74 mm was achieved. On the other hand, the sample β annealed in accordance with the method of the invention had an average grain size of only 0.58 mm. In addition, it was determined that the deviation of the grain sizes from the previously cited average value is less in the sample β-annealed in accordance with the invention then in the one that was subjected to a traditional β annealing.

Figure 2:
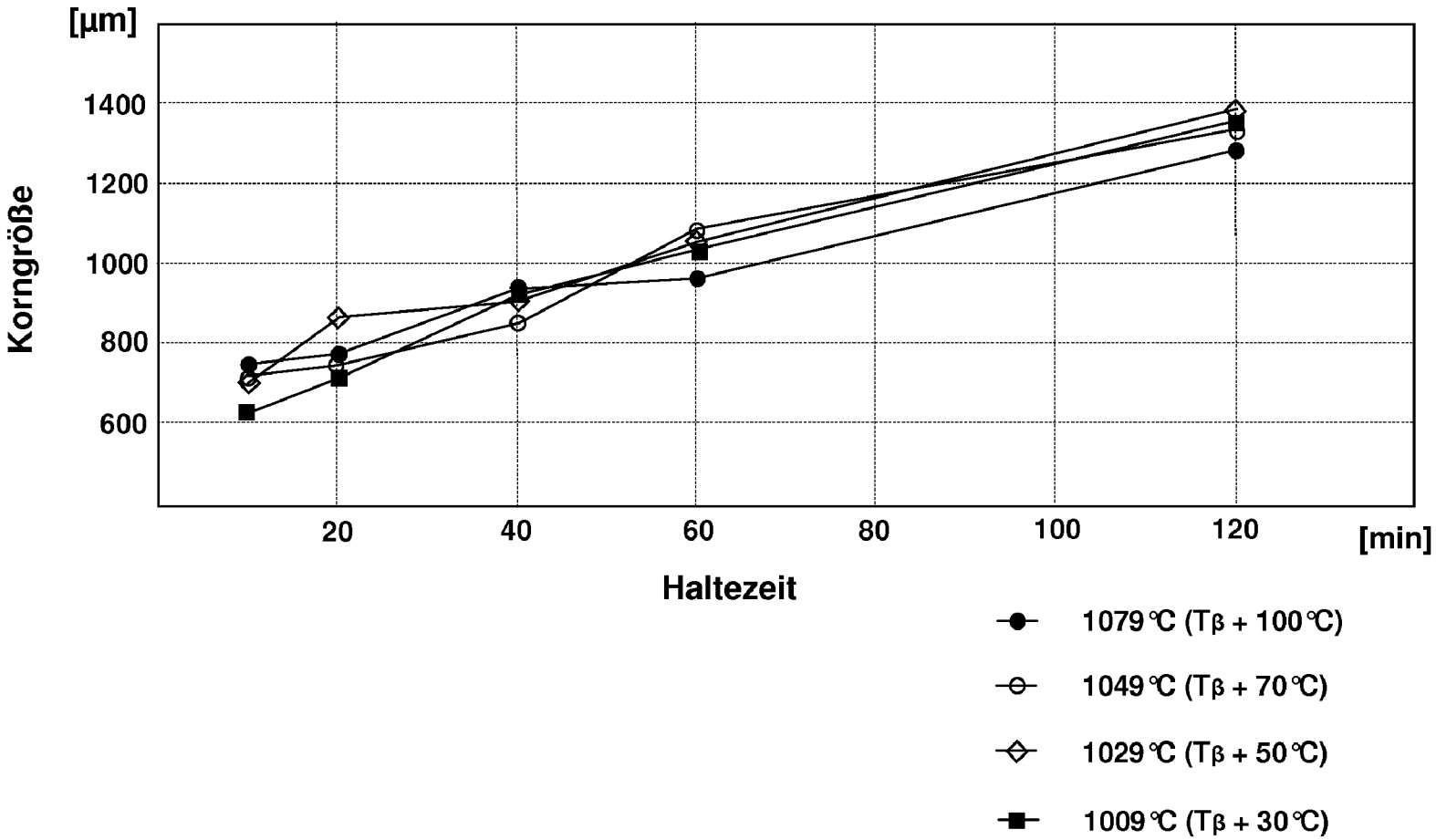
FIG. 2 is a diagram representing the grain growth of a work piece consisting of a Ti alloy as a function of the holding time at different temperatures.

FIG. 2 shows a grain size comparison diagram in which the grain size is entered as a function of the holding time of the alloy Ti6A14V also used for the annealing tests. Four curves that differ as regards the temperature of the holding time are entered in the diagram.

The four samples had the following alloy composition:

| Al | V | Fe | O | C | N | H | Y | Others, individually | Others, sum | Ti |
|---|---|---|---|---|---|---|---|---|---|---|
| 5.92 | 3.82 | 0.18 | 0.11 | 0.006 | 0.005 | 0.0035 | <0.005 | <0.10 | <0.30 | remainder |

The curves entered in FIG. 2 make it clear that in the observed temperature window ($T_\beta$+30° C. to $T_\beta$+100° C.) the grain size is substantially a function of the holding time and only in a subordinate manner of the temperature level of the holding time. The curves do not differ significantly from each other and are located within the accuracy of measurement. The determination of this was unexpected and did not correspond to the prevailing opinion.

It is clear from the description of the method of the invention that the higher the furnace setting temperature is, the shorter the time span between the time of the achieving of the β transus temperature and between the temperature $T_H$ is. Therefore, this time section is in a range of the heating-up curve with a larger heating gradient. Since phase changes can already occur in the temperature interval between $T_\beta$ and $T_H$, but this time span is not part of the holding time, it becomes clear that this time span, which is not defined relative to the standardized method, is considerably minimized in the method of the invention. Consequently, the process safety of the work pieces heat-treated with this method is correspondingly greater.

The invention was described using exemplary embodiments. Tests have shown that other Ti alloys are also suitable for carrying out this β annealing, such as, for example, a Ti6A14V ELI or a Ti 6-22-22 alloy. Furthermore, this β annealing method is also suitable for other α-β Ti alloys.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and subcombinations possible of the group are intended to be individually included in the disclosure.

In general the terms and phrases used herein have their art-recognized meaning, which can be found by reference to standard texts, journal references and contexts known to those skilled in the art. The above definitions are provided to clarify their specific use in the context of the invention.

The invention claimed is:

1. A method for the heat treatment of a work piece produced from a Ti alloy for obtaining a fine-grained structure by annealing the work piece above its β transus temperature ($T_\beta$) (β annealing) comprising the steps of:

heating the work piece to a chosen temperature level ($T_H$) provided for holding above its β transus temperature ($T_\beta$) in a furnace;

starting a predefined holding time of a chosen duration upon the work piece achieving the temperature level ($T_H$);

holding the work piece at the temperature level ($T_H$) for the duration of the holding time; and subjecting the work piece to a cooling-off process, wherein the furnace has an adjusted furnace temperature ($T_F$) for heating the work piece to the temperature level provided for carrying out the holding which is at least 20° C. above the temperature level ($T_H$) of the work piece that determines the beginning of the holding time;

wherein after the heating of the work piece to the temperature level ($T_H$) the furnace temperature is lowered to a lower furnace temperature;

wherein after the heating of the work piece to the temperature level ($T_H$) the furnace temperature is lowered to the temperature level ($T_H$) that determines the beginning of the holding time.

2. The method according to claim 1, wherein the adjusted furnace temperature for heating the work piece to its holding temperature ($T_H$) is not more than 100° C. above the temperature level ($T_H$) provided for the holding.

* * * * *